US011116043B2

(12) United States Patent
Ermanoski et al.

(10) Patent No.: US 11,116,043 B2
(45) Date of Patent: Sep. 7, 2021

(54) HIGH TEMPERATURE HEATER LAMP

(71) Applicant: ARIZONA BOARD OF REGENTS ON BEHALF OF ARIZONA STATE UNIVERSITY, Scottsdale, AZ (US)

(72) Inventors: Ivan Ermanoski, Tempe, AZ (US); Xiang Gao, Tempe, AZ (US); Ryan Milcarek, Gilbert, AZ (US)

(73) Assignee: Arizona Board of Regents on behalf of Arizona State University, Scottsdale, AZ (US)

( * ) Notice: Subject to any disclaimer, the term of this patent is extended or adjusted under 35 U.S.C. 154(b) by 0 days.

(21) Appl. No.: 17/115,685

(22) Filed: Dec. 8, 2020

(65) Prior Publication Data

US 2021/0176827 A1 Jun. 10, 2021

Related U.S. Application Data

(60) Provisional application No. 62/945,835, filed on Dec. 9, 2019.

(51) Int. Cl.

| | |
|---|---|
| ***H05B 3/00*** | (2006.01) |
| ***H05B 3/44*** | (2006.01) |
| ***H01K 1/06*** | (2006.01) |
| ***H01K 1/40*** | (2006.01) |
| ***H01K 1/32*** | (2006.01) |
| ***H01K 1/36*** | (2006.01) |
| ***H01K 1/08*** | (2006.01) |
| *H05B 3/12* | (2006.01) |

(52) U.S. Cl.
CPC ..... *H05B 3/0038* (2013.01); *H01K 1/06* (2013.01); *H01K 1/08* (2013.01); *H01K 1/32* (2013.01); *H01K 1/36* (2013.01); *H01K 1/40* (2013.01); *H05B 3/44* (2013.01); *H05B 3/12* (2013.01)

(58) Field of Classification Search
None
See application file for complete search history.

(56) References Cited

U.S. PATENT DOCUMENTS 3,450,924 A * 6/1969 Knochel ..... H01J 61/36 313/625
4,588,923 A * 5/1986 Hoegler ..... H01K 1/325 313/112

* cited by examiner

*Primary Examiner* — Vip Patel
(74) *Attorney, Agent, or Firm* — Rodney J. Fuller; Booth Udall Fuller, PLC

(57) ABSTRACT

A high temperature heater lamp including a ceramic envelope is disclosed. The ceramic envelope is substantially infrared transparent and is composed of a refractory ceramic. The heater lamp also includes two lead wires communicatively coupled via a filament. The filament is enclosed within the ceramic envelope, which is evacuated. The heater lamp may include at least two metallic IR shields within the ceramic envelope, at least one located on either side of the filament. The filament may be tungsten, a carbon filament, or molybdenum. At least one end of the ceramic envelope may be sealed with a metal cap affixed to the ceramic envelope by a high vacuum sealant. The heater lamp may be configured to operate at above 1500° C. The ceramic envelope may have a wall thickness less than 1 mm thick.

8 Claims, 3 Drawing Sheets

HIGH TEMPERATURE HEATER LAMP

RELATED APPLICATIONS

This application claims the benefit of U.S. provisional patent application 62/945,835, filed Dec. 9, 2019 titled "High-Temperature Heater Lamp," the entirety of the disclosure of which is hereby incorporated by this reference.

TECHNICAL FIELD

Aspects of this document relate generally to high temperature heater lamps.

BACKGROUND

The reduction reaction in thermochemical cycles requires a high-density heat source, to meet its energy demand at high temperature. Concentrating solar systems can cover this demand sustainably. However, these systems include additional energy losses (e.g. optical, re-radiation, etc.) that could reduce the final conversion efficiency by 30-50%. In addition, to be cost-effective, these systems often require large prototypes and plants, which are capital-intensive and discourage the development of the technology.

Driving a reduction reaction in thermochemical cycles with a high-density heat source powered by a form of renewable energy other than concentrating solar faces a different set of problems. While the use of electric heaters may solve some of the inefficiencies of concentrating solar, conventional high temperature heaters, such as silicon carbide and molybdenum disilicide, are expensive. These refractory ceramic materials are used as heating elements. In addition to being expensive, they are not chemically inert and have low power density, limiting their applications. Additionally, while they can reach high temperatures, they are slow to ramp up and down. This complicates their use with intermittent power inputs directly from renewable sources such as wind and solar.

Filament based heaters, conventionally enclosed in a quartz envelope, are able to ramp up in temperature quickly. However, these heaters are not able to reach the high temperatures needed for an efficient thermochemical cycle. Quartz, while inexpensive, has an operating limit of about 900° C. in air, and is very sensitive to exposure to some common chemicals (e.g. the sodium and potassium transferred from a human touch can permeate a quartz envelope and compromise the filament).

SUMMARY

According to one aspect, a high temperature heater lamp includes a ceramic envelope having an interior. The ceramic envelope is composed of a refractory ceramic that is substantially infrared transparent. The heater lamp also includes a filament composed of a refractory material and enclosed within the ceramic envelope, and two lead wires communicatively coupled to each other via the filament. The refractory ceramic is alumina, and the interior of the ceramic envelope is evacuated.

Particular embodiments may comprise one or more of the following features. The high temperature heater lamp may further include at least two metallic IR shields within the ceramic envelope. At least one metallic IR shield may be located on either side of the filament. The refractory material may include tungsten. The filament may be a carbon filament. The refractory material may include molybdenum. At least one end of the ceramic envelope may be sealed with a metal cap affixed to the ceramic envelope by an ultra-high vacuum sealant. The heater lamp may be configured to operate at above 1500° C. The ceramic envelope may have a wall thickness less than 1 mm thick.

According to another aspect of the disclosure, a high temperature heater lamp includes a ceramic envelope having an interior. The ceramic envelope includes a refractory ceramic that is substantially infrared transparent. The heater lamp also includes a filament composed of a refractory material and enclosed within the ceramic envelope, and two lead wires communicatively coupled to each other via the filament.

Particular embodiments may comprise one or more of the following features. The interior of the ceramic envelope may be filled with an inert gas. The interior of the ceramic envelope may be evacuated. The high temperature heater lamp may further include at least two metallic IR shields within the ceramic envelope. At least one metallic IR shield may be located on either side of the filament. The refractory ceramic may be alumina. The refractory material may include tungsten. The filament may be a carbon filament. The refractory material may include molybdenum. At least one end of the ceramic envelope may be sealed with a metal cap. The metal cap may be affixed to the ceramic envelope by a high vacuum sealant. The heater lamp may be configured to operate at above 1500° C. The ceramic envelope may have a wall thickness less than 1 mm thick.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The disclosure will hereinafter be described in conjunction with the appended drawings, where like designations denote like elements, and.

DETAILED DESCRIPTION

Figure 1:
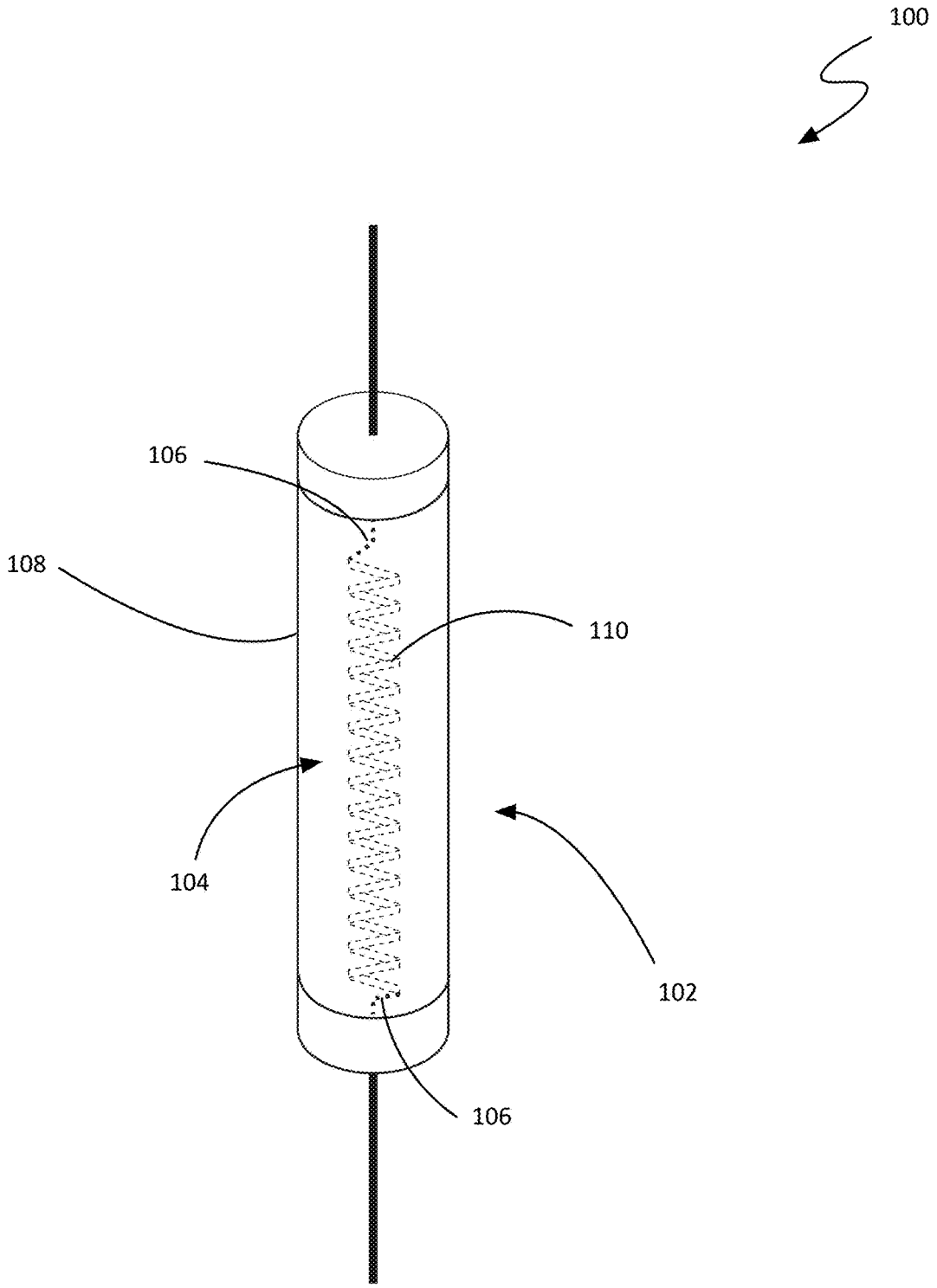
FIG. 1 is a perspective view of a high temperature heater lamp.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

The reduction reaction in thermochemical cycles requires a high-density heat source, to meet its energy demand at high temperature. Concentrating solar systems can cover this demand sustainably. However, these systems include additional energy losses (e.g. optical, re-radiation, etc.) that could reduce the final conversion efficiency by 30-50%. In addition, to be cost-effective, these systems often require large prototypes and plants, which are capital-intensive and discourage the development of the technology.

Driving a reduction reaction in thermochemical cycles with a high-density heat source powered by a form of renewable energy other than concentrating solar faces a different set of problems. While the use of electric heaters may solve some of the inefficiencies of concentrating solar, conventional high temperature heaters, such as silicon carbide and molybdenum disilicide, are expensive. These refractory ceramic materials are used as heating elements. In addition to being expensive, they are not chemically inert and have low power density, limiting their applications. Additionally, while they can reach high temperatures, they are slow to ramp up and down. This complicates their use with intermittent power inputs directly from renewable sources such as wind and solar.

Filament based heaters, conventionally enclosed in a quartz envelope, are able to ramp up in temperature quickly. However, these heaters are not able to reach the high temperatures needed for an efficient thermochemical cycle. Quartz, while inexpensive, has an operating limit of about 900° C. in air, and is very sensitive to exposure to some common chemicals (e.g. the sodium and potassium transferred from a human touch can permeate a quartz envelope and compromise the filament).

Contemplated herein is a high temperature heater lamp that is able to achieve high temperatures, up to and possibly exceeding 1900° C. These high temperature heater lamps (hereinafter "heater lamp") are also able to heat and cool rapidly, with high ramp up/down rates. Additionally, the heater lamps contemplated herein have a higher power per unit heater area than conventional heaters.

Some conventional heaters are able to reach high temperatures, and some are able to heat and cool quickly, but none of them are able to do both. Advantageously, the high-temperature heater lamps contemplated herein are able to compete with the best of both types, reaching the higher temperatures at the higher ramp up rates.

Not only do the high-temperature radiant heater lamps disclosed herein improve on the performance and power density of conventional high-temperature heat sources, they do so in a less expensive package. The heater lamp utilizes low-cost manufacturing techniques and materials. In some cases, the cost of the contemplated heater lamps are an order of magnitude less expensive than conventional heaters that reach the same temperature range.

The contemplated heater lamps are ideal for use with thermochemical cycles. The heater lamp decouples the thermochemical cycles from direct solar radiation, moving the heat source inside the reactor itself and minimizing radiative heat loses. Additionally, the heater lamp reduces substantially the capital cost of the system, scales more flexibly, and has a fast response suitable for intermittent and relatively unconditioned power inputs, according to various embodiments. The contemplated heater lamp may also open up applications that are not practical using conventional high temperature electric heating technology, beyond thermochemical cycles.

FIG. 1 is a perspective view of a non-limiting example of a high temperature heater lamp. As shown, the heater lamp 100 comprises a ceramic envelope 102. Housed inside the ceramic envelope 102 is a filament 104 communicatively coupled to two lead wires 106. According to various embodiments, the interior 112 of the ceramic envelope 102 is either evacuated or filled with an inert gas, as will be discussed in greater detail with respect to FIGS. 2 and 3, below.

Conventional high temperature heaters sometimes make use of refractory ceramics as heating elements that are expensive, slow, and have low power density. The heater lamps contemplated herein comprise a ceramic envelope 102 that is composed of, at least in part, a refractory ceramic 108 that is substantially transparent or translucent in the infrared range of the electromagnetic spectrum. In the context of the present description and the claims that follow, substantially transparent means at least 60% transparent. It should be noted that in some embodiments, the refractory ceramic 108 may be between 70% and 80%, and in other embodiments, the transparency may be higher. This transparency permits radiant heat to leave the heater lamp 100 without directly and substantially heating the envelope 102, thereby enabling good heat transfer from the heater lamp 100. Additionally, the ceramic envelope 102 is impervious to gasses, in particular oxygen, according to various embodiments.

The ceramic envelope 102 is composed of a ceramic material able to withstand the operating temperatures of the enclosed filament 104, as well as the strain of repeated heating and cooling cycles. According to various embodiments, the ceramic envelope 102 may be composed of alumina. Most substances do not react with alumina, which is able to withstand very high temperatures. Advantageously, alumina does not conduct oxygen like some refractory ceramics, and is substantially transparent in the infrared range of the electromagnetic spectrum (e.g. 70%-90%, etc.). Furthermore, alumina is inexpensive, and strong enough that the ceramic envelope 102 may be constructed with thin walls, further facilitating heat transfer.

Embodiments of the contemplated heater lamp 100 making use of a ceramic envelope 102 composed of alumina have been shown to be sufficiently robust as well as effective. For example, in one specific embodiment, a ceramic envelope 102 composed of alumina was able to withstand over seven hundred 200° C. heating and cooling cycles oscillating around 1500° C., as well as reach temperatures above 1700° C.

Other examples of refractory ceramic 108 include, but are not limited to, nitrides (e.g. ZrN, etc.), borides (e.g. $HfB_2$, etc.), oxides (e.g. early transition metal oxides, $Y_2O_3$, $ThO_2$, etc.), and other ceramics known in the art. In some embodiments, the ceramic envelope 102 may also be chemically inert, chemically stable (particularly in air), have a high melting point, a large band gap, no oxygen vacancies in the crystal structure, strong enough to withstand operation while also remaining thin enough to permit good heat transfer, and/or impermeable to gas.

As shown, the heater lamp 100 also comprises a filament 104. In the context of the present description and the claims that follow, a filament is an active heating element composed of a conductive refractory material 110. The filament 104 may have the form of a wire, a ribbon, or any other shape known in the art. Some embodiments may have a single filament structure, while other embodiment may employ a filament 104 composed of multiple structures, all joined at either ends. The filament 104 is communicatively coupled to a pair of lead wires 106, as shown. The use of a filament 104 in conjunction with a ceramic envelope 102 allows the heater lamp 100 to reach high temperatures with rapid ramp up and down rates.

According to various embodiments, the filament 104 is composed, at least in part, of a conductive refractory material 110. In some embodiments, the refractory material 110 is tungsten. Tungsten has a long history of use in light bulbs, resulting in highly developed techniques in shaping and using tungsten as a filament, resulting in low cost. Other embodiments may employ one or more carbon filaments, which can also be inexpensive. Other examples of conductive refractory materials 110 include, but are not limited to, molybdenum, tantalum, and other materials known in the art that will not sublimate at the contemplated temperatures (e.g. 1500° C. and higher). While more expensive than some of the other exemplary materials, tantalum may be advantageous in embodiments of the heater lamp 100 used in environments having significant vibrations, as tantalum filaments tend to be more mechanically stable due to recrystallization properties not found in the other materials.

Figure 2:
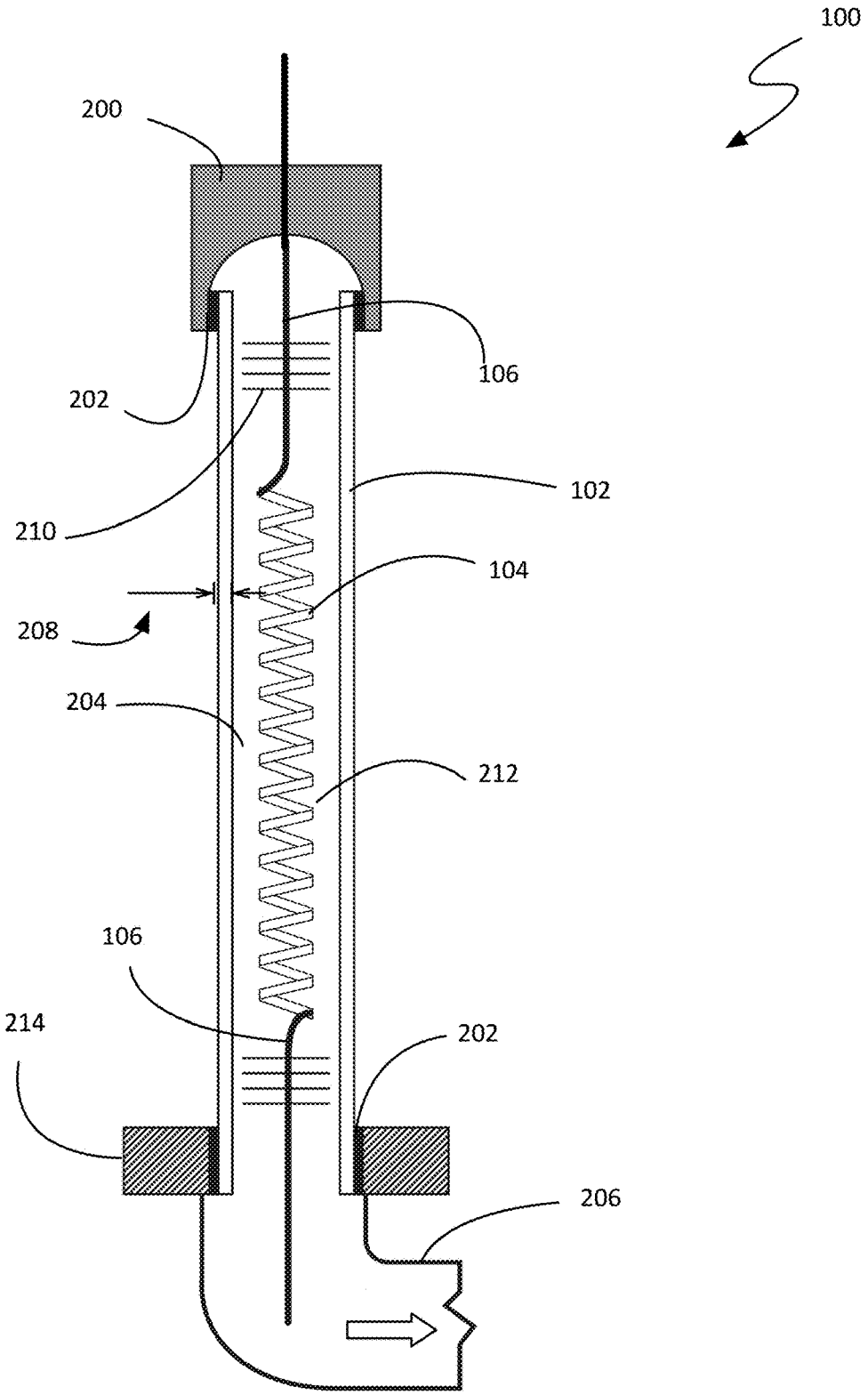
FIG. 2 is a cross-sectional view of a high temperature heater lamp on a vacuum line.

FIG. 2 is a cross-sectional view along the central axis of a non-limiting example of a high temperature heater lamp 100. As shown, one end of the ceramic envelope 102 is sealed with a metal cap 200, while the other end is sealed to a flange 214 coupled to a vacuum line 206. According to various embodiments, the interior 212 of the ceramic envelope 102 may be evacuated. In some embodiments, that vacuum 204 may be maintained by attaching the heater lamp 100 to a vacuum line 206, or other vacuum system, through a flange 214 affixed to the end of the ceramic envelope 102. In other embodiments, the ceramic envelope 102 may be evacuated through an evacuation tube sealed inside the envelope 102, passing through a cap (not shown). According to various embodiments, the interior 212 of the ceramic envelope 102 may be evacuated to a pressure less than $10^{-4}$ Pa. In some embodiments, the total pressure may be less than $10^{-6}$ Pa. In some embodiments, the evacuation of the ceramic envelope 102 may result in a partial pressure of oxygen less than $10^{-10}$ Pa, and of water vapor less than $10^{-9}$ Pa.

The ceramic envelope 102 is sealed such that a vacuum or an inert gas may be maintained within, to maintain the necessary oxidizer-free environment. As shown, in some embodiments, one or both ends may be sealed with a metal cap 200. As a specific example, in one embodiment, the metal cap 200 may be composed of stainless steel. In other embodiments, the metal cap 200 may be composed of other metals known in the art. In still other embodiments, the end cap may be composed of materials other than metals, given that their thermal expansion is similar enough to that of the ceramic envelope 102 that the seal, cap, and/or envelope 102 are not compromised during the temperature cycling anticipated for the heater lamp, which may vary depending on the intended application and the refractory ceramic 108 used.

One of the difficulties in using a refractory ceramic 108 to construct the envelope 102 is that, unlike quartz, forming the envelope 102 with good tolerances usually requires processing the envelope 102 after creation, which greatly increases the cost. According to various embodiments, rather than increase the manufacturing cost, the poor tolerances common to ceramics may be dealt with using a sealant.

Figure 3:
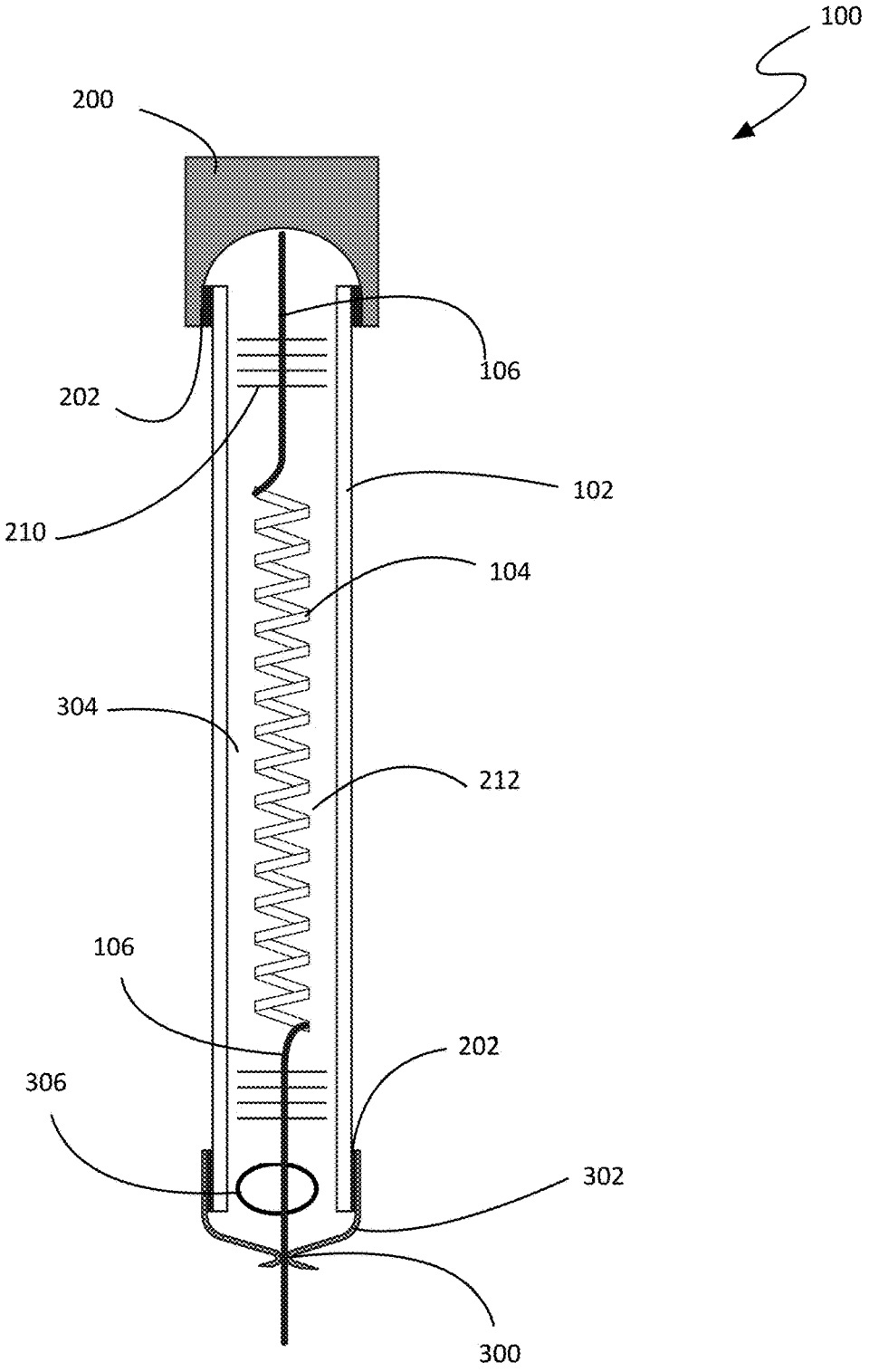
FIG. 3 is a cross-sectional view of a stand-alone high temperature heater lamp.

In some embodiments, the metal cap 200 (and/or flange 214) may be affixed to the ceramic envelope 102 using a high or ultra-high vacuum sealant 202. In some embodiments, the cap 200 may be bonded to the envelope 102 using a resin sealant, such as a silicone resin sealant. It should be noted that the size of the sealant shown in FIGS. 2 and 3 is not to scale, and has been exaggerated for clarity. According to various embodiments, a thin layer of sealant 202 is applied to both surfaces (i.e. envelope, cap) before they are mated and allowed to cure. High vacuum sealant advantageously tends to remain slightly flexible even when cured, preventing cracking or leaks, particularly when bonding two materials with different coefficients of thermal expansion. As a specific example, in one embodiment, the cap 200 and/or flange 214 may be bonded to the envelope 102 using KL-5 vacuum leak sealant, from the Kurt J. Lesker Company.

As shown, in some embodiments, the heater lamp 100 may further comprise at least two metallic infrared shields 210. In the context of the present description and the claims that follow, an infrared shield 210 is an object that is substantially impervious to infrared radiation that is placed between the filament 104 and the ends of the envelope 102 to prevent heat from the filament 104 from escaping the ends and damaging the colder parts of the heater lamp 100. According to various embodiments, the heater lamp 100 may be configured to keep the ends of the envelope relatively cool (e.g. 200° C., etc.) in comparison to the middle of the heater lamp 100, where the filament 104 is located. The metallic infrared shields 210 prevent the filament 104 from overly heating the ends of the heater lamp 100, and helps direct the heat outward, through the envelope 102 and into the desired target.

In some embodiments, the infrared shields 210 may be metallic foils. As a specific example, in one embodiment, the IR shields 210 may be foils composed of tantalum, which has desirable mechanical and thermal properties that make it well adapted for use as an IR shield 210. In some embodiments, there may be multiple shields 210 on either side of the filament 104. In still other embodiments, the heater lamp 100 may not have any infrared shields 210.

In some embodiments, the heater lamp 100 may be single ended, having both lead wires 106 exit the same end of the envelope 102. In other embodiments, the heater lamp 100 may be double ended, with one lead wire 106 exiting the envelope 102 at one end, and the other lead wire 106 exiting the opposite end. See, for example, the non-limiting examples shown in FIGS. 2 and 3.

According to various embodiments, the ceramic envelope 102 may be cylindrical tube. Such a shape is advantageous, as it is well adapted to resisting the mechanical stress caused by the thermal shock due to the heater lamp 100 ramping up or down in temperature. Other embodiments may employ other geometries known for their resistance to thermal shock, including geometries having more than one filament 104. For example, in one embodiment, the ceramic envelope 102 may resemble the partial merging of two cylindrical envelopes, each having a filament 104. Those skilled in the art will recognize that other shapes known to be robust against temperature fluctuations and mechanical stress may also be applied.

One of the advantages of constructing the envelope 102 from a ceramic material is that, due to its mechanical strength, the wall thickness 208 of the envelope 102 may be reduced, increasing the efficiency of heat transfer without sacrificing durability. In some embodiments, the ceramic envelope 102 may be constructed with wall thickness 208 lower than any practical wall thickness for a quartz envelope. In some embodiments, the wall thickness 208 of a ceramic envelope 102 having a quarter inch diameter may be less than 1 mm (e.g. 0.5 mm, 0.75 mm, etc.). Typical quartz tubes having that same diameter have a wall thickness of at least 1 mm. In other embodiments, the wall thickness 208 may be 1 mm, or more, depending on the envelope diameter.

FIG. 3 is a cross-sectional view along the central axis of a non-limiting example of another embodiment of a high temperature heater lamp. Specifically, FIG. 3 shows an embodiment of the heater lamp 100 that is stand-alone, not requiring connection to a vacuum system or source of inert gas 304. This particular non-limiting example is filled with an inert gas 304. In embodiments where the operating temperature of the filament is below the point of sublimation, a vacuum filled envelope 102 may be preferred, since it would eliminate heat transfer to the envelope 102 through convention. However, in embodiments making use of refractory ceramics 108 that are rated for temperatures closer to the maximum operating temperature of the filament 104, the use of an inert gas 304 may be advantageous.

The non-limiting example of a heater lamp 100 shown in FIG. 3 is stand-alone, meaning both ends have been sealed, and connection to a vacuum system or source of inert gas is not needed. As shown, the heater lamp 100 may further comprise a getter 306, to absorb any residual oxidizing gas, or any gas that gets through the seal, prolonging the life of the filament 104.

Those skilled in the art will recognize that there are a number of ways the ceramic envelope 102 may be sealed while under vacuum or filled with inert gas. For example, as shown, in some embodiments the envelope 102 may be sealed with a cold weld 300, where a pure copper tube 302, bonded to the envelope 102 with sealant 202, is pinched while under vacuum, causing the metal to bond with itself forming the cold weld 300, as is known in the art. Those skilled in the art will recognize that other materials and methods may be used to seal the ceramic envelope 102 while under vacuum or filled with inert gas 304.

Where the above examples, embodiments and implementations reference examples, it should be understood by those of ordinary skill in the art that other high temperature heater lamp examples could be intermixed or substituted with those provided. In places where the description above refers to particular embodiments of a high temperature heater lamp, it should be readily apparent that a number of modifications may be made without departing from the spirit thereof and that these embodiments and implementations may be applied to other high temperature radiant heater technologies as well. Accordingly, the disclosed subject matter is intended to embrace all such alterations, modifications and variations that fall within the spirit and scope of the disclosure and the knowledge of one of ordinary skill in the art.

What is claimed is:

1. A high temperature heater lamp, comprising:

a ceramic envelope having an interior, the ceramic envelope composed of a refractory ceramic that is substantially infrared transparent;

a filament composed of a refractory material and enclosed within the ceramic envelope; and two lead wires communicatively coupled to each other via the filament;

wherein the refractory ceramic is alumina;

wherein the interior of the ceramic envelope is evacuated.

2. The high temperature heater lamp of claim 1, further comprising:

at least two metallic IR shields within the ceramic envelope;

wherein at least one metallic IR shield is located on either side of the filament.

3. The high temperature heater lamp of claim 1, wherein the refractory material comprises tungsten.

4. The high temperature heater lamp of claim 1, wherein the filament is a carbon filament.

5. The high temperature heater lamp of claim 1, wherein the refractory material comprises molybdenum.

6. The high temperature heater lamp of claim 1, wherein at least one end of the ceramic envelope is sealed with a metal cap affixed to the ceramic envelope by an ultra-high vacuum sealant.

7. The high temperature heater lamp of claim 1, wherein the heater lamp is configured to operate at above 1500° C.

8. The high temperature heater lamp of claim 1, wherein the ceramic envelope has a wall thickness less than 1 mm thick.

* * * * *